US008627519B2

(12) United States Patent
Jacobs

(10) Patent No.: US 8,627,519 B2
(45) Date of Patent: Jan. 14, 2014

(54) MAIN DRAIN OUTLET FOR A SWIMMING POOL, WADING POOL, SPA, OR HOT TUB

(76) Inventor: Bob G. Jacobs, Myrtle Beach, SC (US)

( * ) Notice: Subject to any disclaimer, the term of this patent is extended or adjusted under 35 U.S.C. 154(b) by 739 days.

(21) Appl. No.: 12/754,243

(22) Filed: Apr. 5, 2010

(65) Prior Publication Data

US 2011/0239362 A1 Oct. 6, 2011

(51) Int. Cl.
*E04H 4/00* (2006.01)

(52) U.S. Cl.
USPC ..... 4/507

(58) Field of Classification Search
USPC ..... 4/507–509; 210/163, 459, 460, 167.16
See application file for complete search history.

(56) References Cited

U.S. PATENT DOCUMENTS 2,004,825 A 6/1935 Ewart
6,170,095 B1 1/2001 Zars
6,615,417 B1 9/2003 Newhard
6,810,537 B1 * 11/2004 Barnes et al. ..... 4/507
7,254,847 B2 8/2007 Kunkel
7,774,870 B2 * 8/2010 Griffin et al. ..... 4/507
2006/0015996 A1 1/2006 Goettl
2007/0180605 A1 8/2007 Griffin

* cited by examiner

*Primary Examiner* — Huyen Le
*Assistant Examiner* — Erin Deery
(74) *Attorney, Agent, or Firm* — Steve Witters; Witters & Associates

(57) ABSTRACT

A main drain outlet and a water sanitation system for a swimming pool, wading pool, spa, or hot tub are provided. A main drain outlet comprises a cylindrical or toroidal sump, an inlet tangentially extending from the cylindrical or toroidal sump having an orifice with a length extending a longitudinal axis of the cylindrical or toroidal sump and a width substantially less than its length. The sump may have a curved inner surface throughout the length of the orifice. The main drain outlet may be of unitary assembly and may have more than one sump and inlet. The main drain outlet may comprise a testing strip. The pool water sanitation system may comprise skimmer flow equalizer lines in flow communication with a main drain outlet.

19 Claims, 15 Drawing Sheets

MAIN DRAIN OUTLET FOR A SWIMMING POOL, WADING POOL, SPA, OR HOT TUB

FIELD OF THE DISCLOSURE

This disclosure relates to water outlets for swimming pools, wading pools, spas, and hot tubs, and more specifically to main drain outlets and skimmers that may reduce safety hazards associated with main drain outlets and skimmers of the prior art.

BACKGROUND

Pool water sanitation systems are configured to sanitize water by pumping the water from the swimming pool water body and water surface, and recycle the same through a filter and back to the water body. Suction outlets, in flow communication with a filter pump, interface with the water body that bathers occupy. These suction outlets typically comprise two main drains located in the floor of the deep portion of the swimming pool. The primary purpose of two main drains is transfer the water to the filter. Typically, the pool water sanitation systems comprise skimmers for transferring pool surface water to the filter for cleansing debris from the pool water surface. Skimmers typically have suction outlets in the wall of the swimming pool that provide water to a skimmer pump in the event the water level in the swimming pool falls below the inlet of the skimmers.

In the prior art, the main drains typically comprise an assembly that includes a grate-like cover that interfaces with the pool water body, with a sump positioned below the cover for a main drain suction line to terminate into, thereby creating a smaller body of pool water that will be in direct contact with the suction forces of the main drain suction line. These grate-like covers may be raised with respect to an inner surface of the swimming pool and may introduce tripping and kicking hazards. Also, in the prior art, to protect the filter pump from "dry flow", in the event the pool water level drops below the entry of the skimmer, the skimmers include a bypass line, referred to as a "flow equalizer" line that terminates at a grate-covered fitting which interfaces with the pool water body. These flow equalizer lines may provide additional suction outlets in the pool.

There are many safety hazards associated with the pool water sanitation systems of the prior art. Suction safety hazards may include entrapment, evisceration, and entanglement of human hair, clothing, and jewelry, for example. Also, the main drain and skimmer assemblies of the prior art typically comprise component parts. These component parts may come apart, introducing safety hazards to the pool with the pool water sanitation system. For example, the grate-like covers may be removed or broken, increasing potential entanglement and suction safety hazards for swimming pool users.

Other deficiencies may be found in the prior art. For example, in the prior art only the main drain piping may be tested for leakage during construction since the main drain sumps and connecting main drain pipes comprise separate assemblies. This may result in added construction time and costs associated with constructing a large field-built leakproof cover for the sump.

What is needed is a main drain outlet and/or skimmer for a swimming pool, wading pool, spa or hot tub that improves upon the deficiencies of the prior art.

SUMMARY

In one aspect of the present disclosure, a main drain suction outlet or skimmer for a swimming pool is provided. The main drain suction outlet comprises a water inlet configured to be disposed substantially within an inner surface of the swimming pool. An orifice is in the water inlet and has a length substantially larger than a width. A sump is in flow communication with the orifice and a sump outlet. The sump comprises a first wall and a second wall wherein the first wall and the second wall terminate at the orifice. A pump is configured and disposed to pump water from the swimming pool, into the orifice, through the sump, and through the sump outlet. The orifice is configured and disposed to maintain any vacuum on a human body below a vacuum required for entrapment or evisceration of the human body upon the human body maximizing blockage of the flow of water into the orifice when the pump is pumping water. The first wall comprises a substantially linear portion adjacent the first orifice. The second wall comprises an outer portion, proximate the orifice, curving away from the substantially linear portion of the first wall and an inner portion curving to the first wall.

In another aspect of the present disclosure, a main drain outlet or skimmer for a swimming pool, wading pool, spa, or hot tub, is provided. The main drain outlet comprises an orifice having a length substantially greater than a width. The orifice is configured to be disposed substantially within an inner surface of the swimming pool, wading pool, spa, or hot tub. A substantially circular sump comprises a first wall, a second wall, and two end walls. The first wall is substantially flat and extends from the orifice to the second wall and to the two end walls. The second wall extends from the orifice to the first wall and to the two end walls. The second wall comprises an outer portion extending from the orifice and is disposed substantially parallel with the first wall. An inner portion of the second wall curves away from the first wall and then curves back to the first wall forming the substantially circular sump. The sump outlet is in flow communication with the orifice and extends from the inner portion of the second wall and is centrally disposed with respect to the two end walls.

In yet another aspect of the present disclosure, a main drain outlet or skimmer for a swimming pool, wading pool, spa, or hot tub is provided. The main drain outlet comprises a cylindrical or toroidal sump. A sump inlet tangentially extends from the cylindrical or toroidal sump and has an opening with a length extending a longitudinal axis of the cylindrical or toroidal sump and a width substantially less than its length. The cylindrical or toroidal sump has a curved inner surface throughout the length of the sump inlet.

In a further aspect of the present disclosure, a main drain outlet or skimmer comprises a cylindrical or toroidal sump, a first end wall enclosing a first end of the cylindrical or toroidal sump, and a second end wall enclosing a second end of the cylindrical or toroidal sump. An outlet port is centrally disposed within the cylindrical or toroidal sump configured to become in flow communication with main drain piping. An accessway cleanout is configured to provide access into the cylindrical or toroidal sump and has a removable cover configured and disposed to cover the accessway cleanout. An orifice tangentially extends from the cylindrical or toroidal sump and extends proximate the first and the second end walls. The cylindrical or toroidal sump, the first end wall, the second end wall, the outlet port, the accessway cleanout, and the orifice are of a unitary assembly.

BRIEF DESCRIPTIONS OF THE DRAWINGS

The following figures, which are idealized, are not to scale and are intended to be merely illustrative of aspects of the present disclosure and non-limiting. In the drawings, like elements are depicted by like reference numerals. The drawings are briefly described as follows.

DETAILED DESCRIPTION

Figure 1:
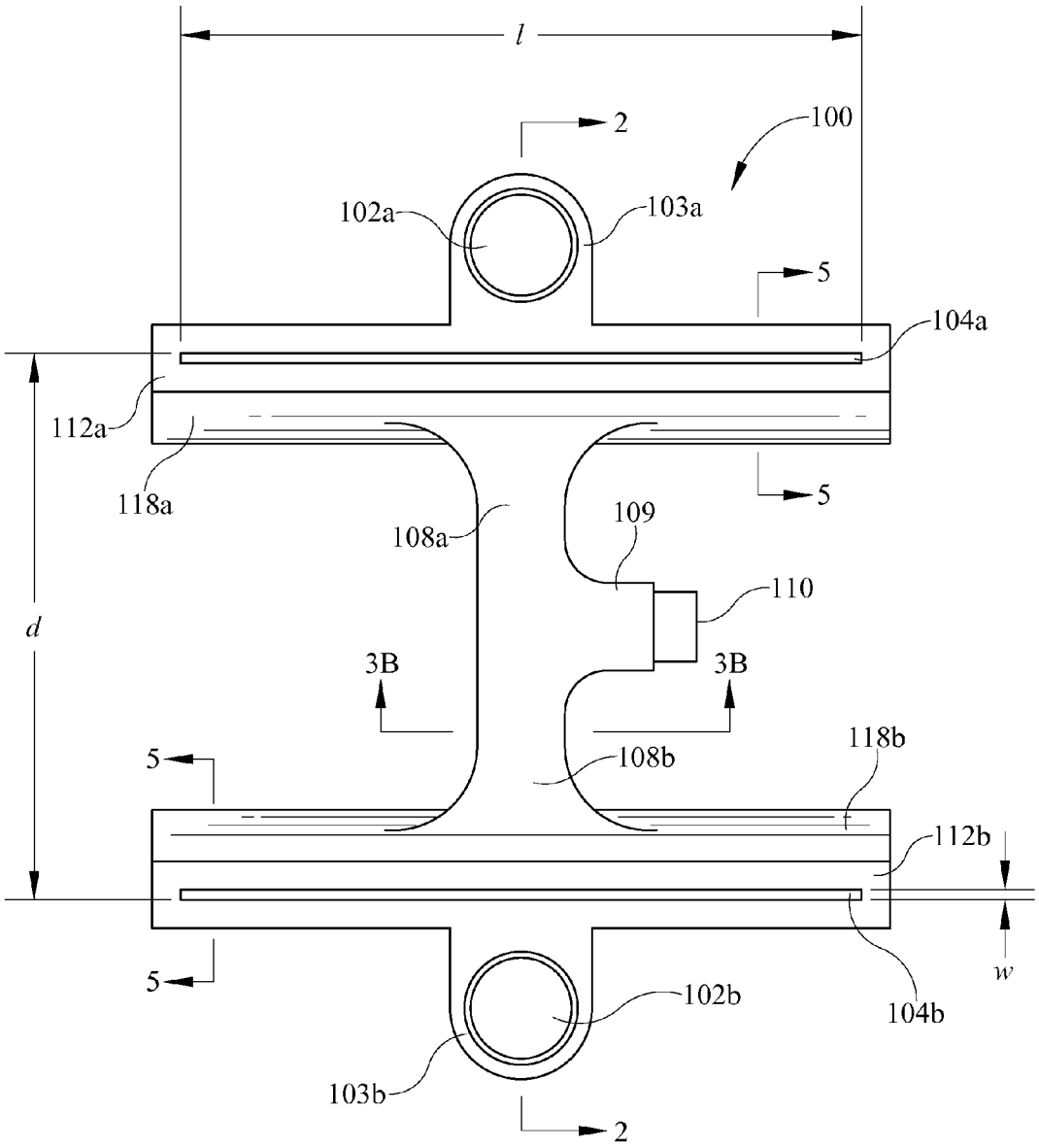
FIG. 1 is a top view of a unitary main drain outlet for a swimming pool, wading pool, spa, or hot tub having two orifices.

FIGS. 1, 2, 3A and 3B show an aspect of a main drain outlet or skimmer for a swimming pool, wading pool, spa, or hot tub of unitary assembly and having two orifices. Specifically, FIG. 1 shows a top view of main drain outlet 100 having two orifices, 104*a* and 104*b*. A first water inlet 112*a* has a planar surface configured to be disposed substantially within a flat inner surface of a swimming pool. A first orifice 104*a*, in first water inlet 112*a*, has a length l substantially larger than a width w. In at least one aspect, length l is at least 38 inches. In at least one other aspect, width w may be less than an inch or the width of a human digit. Width w may be about ½ inch or small or larger, in 1/16 inch increments, for example, width w may be about 7/16 inch. A first sump 118*a* is in flow communication with the first orifice 104*a* and a first sump outlet 108*a*. A second water inlet 112*b* has a planar surface configured to be disposed substantially within the flat inner surface of a swimming pool. A second orifice 104*b*, in second water inlet 112*b*, has a length l substantially larger than a width w. A second sump 118*b* is in flow communication with second orifice 104*b* and a second sump outlet 108*b*.

In at least one aspect, one or both sumps, 118*a* and/or 118*b*, have an access port, 103*a* and/or 103*b*, configured and disposed to provide access to sumps 118*a* and/or 118*b*, for cleaning. Access port 103*a* is configured and disposed to provide access to sump 118*a* while access port 103*b* is configured and disposed to provide access to sump 118*b*. Access ports 103*a* and 103*b* extend from sumps 118*a* and 118*b* respectively and are centrally disposed with respect to the length l of orifices 104*a* and 104*b*. Each access port 103*a* and 103*b* has an opening covered with a removable access port cover, 102*a* and 102*b*, respectively. Removable access port covers 102*a* and 102*b* are configured to be disposed substantially within the inner surface of a swimming pool, wading pool, spa, or hot tub.

Sump outlets 108*a* and 108*b* are in flow communication with each other and outlet 109. Outlet 109 has water exit port 110 configured to be in flow communication with a main drain pipe. In at least one aspect, outlet 109 may be in flow communication with a pump and main drain outlet 100 may be referred to as a suction outlet, as may be advantageous in a swimming pool. In another aspect, outlet 109 drains sumps 118*a* and 118*b* by gravity flow, as may be advantageous in a wading pool or other recreational water system.

Figure 2:
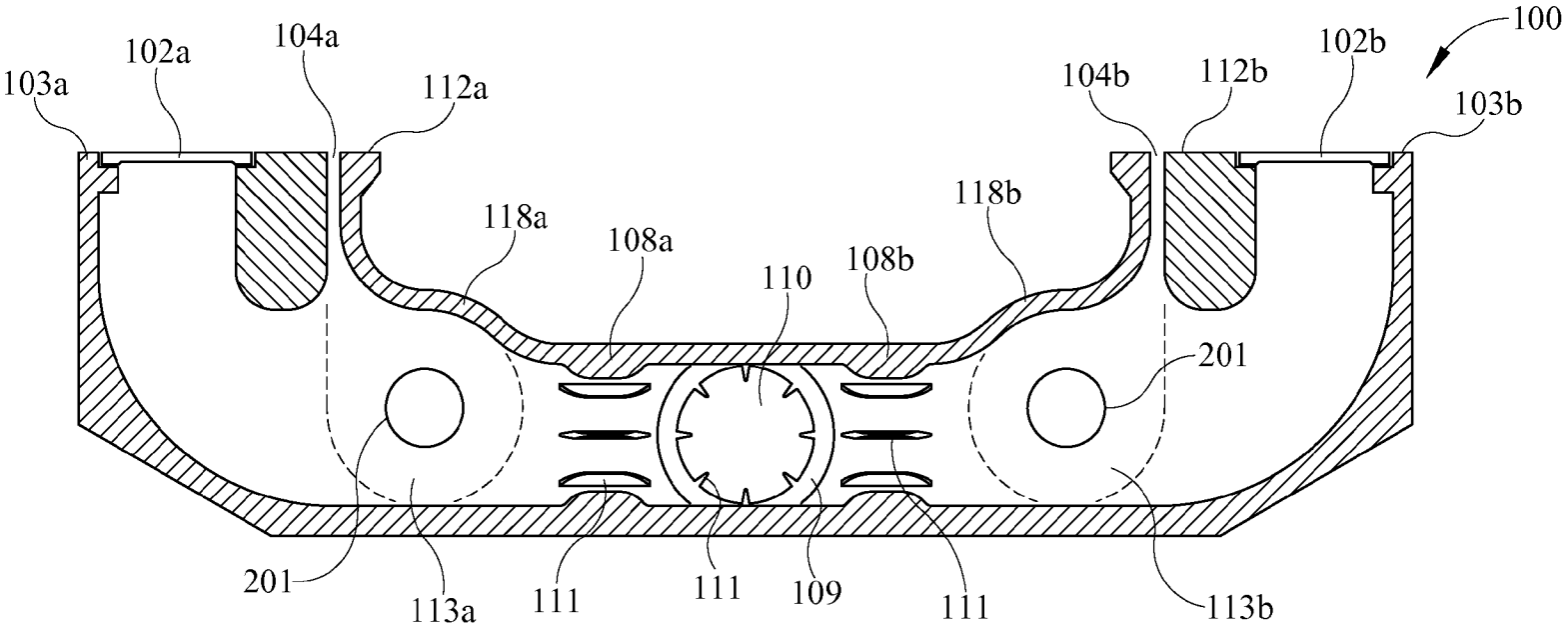
FIG. 2 is a cross-sectional view of the main drain outlet of FIG. 1 taken along sectional lines 2-2.

FIG. 2 is a cross-sectional view of main drain outlet 100 taken along sectional lines 2-2, of FIG. 1. First sump 118*a* is in flow communication with first orifice 104*a* and a first sump outlet 108*a*. Second sump 118*b* is in flow communication with second orifice 104*b* and second sump outlet 108*b*. Sumps 118*a* and 118*b* have an access port, 103*a* and 103*b* respectively, configured and disposed to provide access to sumps 118*a* and or 118*b*, for cleaning. Each access port 103*a* and 103*b* has an opening covered with a removable access port cover, 102*a* and 102*b*, respectively. Sump outlets 108*a* and 108*b* are in flow communication with each other and outlet 109.

Sump outlets 108*a* and 108*b* may have laminar flow blades 111. Additionally or alternatively, outlet 109 may have laminar flow blades 111. Laminar flow blades 111 are optional and are configured and disposed to induce laminar flow of water, as opposed to turbulent flow, through main drain outlet 100. Providing laminar flow through main drain outlet 100 may decrease entanglement hazards associated with main drain outlets of the prior art. For example, turbulent flow may cause a bathing suit draw string to become knotted inside a sump and prohibit it from being removed from a sump opening. Laminar flow through sump 100 may tend to pull the bathing suit draw string toward outlet 109 without knotting, allowing it to be pulled back out of an orifice 104*a* or 104*b*. In at least one aspect of main drain 100, laminar flow blades 111 are not needed as laminar flow may be provided with the configuration and disposition of orifices 104*a* and 104*b*, sumps 118*a* and 118*b*, and sump outlets 108*a* and 108*b*. In other aspects, laminar flow blades 111 may be in sump outlets 108*a* and 108*b* and/or outlet 109, which may induce laminar flow through main drain 100 and reduce health risks associated with turbulent flow in a main drain.

Also shown in FIG. 2, is a circular or cylindrical configuration of sumps 118*a* and 118*b*. Sumps 118*a* and 118*b* extend longitudinally with orifices 104*a* and 104*b*, respectively, to an end wall 113*a* or 113*b*. One or more of end walls 113*a* and 113*b* may have a port 201 configured to be in flow communication with at least one skimmer equalizer line. Ports 201 may be centered in the circular portion of the end wall.

Figure 3A:
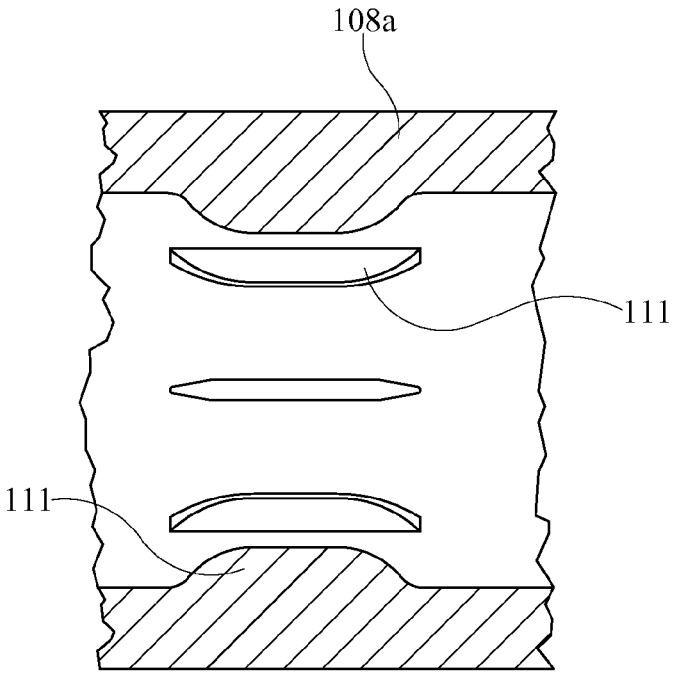
FIG. 3A is a longitudinal cross-sectional view of a sump outlet of the main drain outlet of FIG. 1 taken along sectional lines 3A-3A of FIG. 3B, showing laminar flow blades.
Figure 3B:
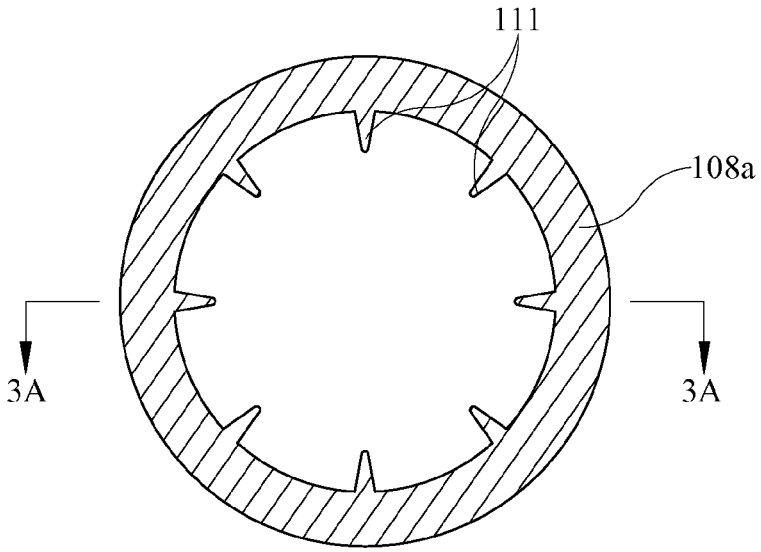
FIG. 3B is an axial cross-sectional view of a sump outlet of the main drain outlet of FIG. 1 taken along sectional lines 3B-3B, showing laminar flow blades.

FIGS. 3A and 3B show a plurality of laminar flow blades 111 disposed in sump outlet 108*a*. FIG. 3A is a longitudinal cross-sectional view of sump outlet 108*a* of main drain outlet 100 of FIG. 1 showing laminar flow blades 111. Laminar flow blades 111 extend inwardly from an inner perimeter of sump outlet 111 and have a length substantially greater than a width. Laminar flow blades 111 have their lengths disposed substantially parallel with a direction of flow of water through sump outlet 108*a* and have their longitudinal ends sloping to an inner surface of sump outlet 108*a*. FIG. 3B is an axial cross-sectional view of a sump outlet 108*a* of the main drain outlet 100 showing laminar flow blades 111 substantially equidistantly spaced about the inner perimeter of sump outlet 108*a* and extending radially inwardly.

Figure 4A:
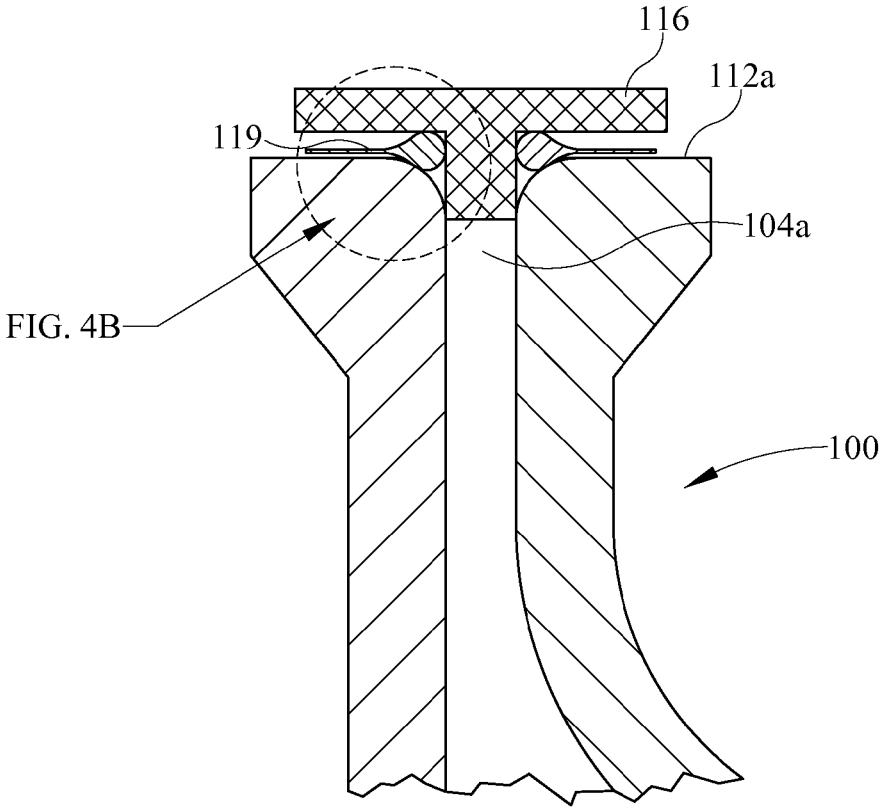
FIG. 4A is a cut-away cross-sectional view of a sump inlet of the main drain outlet of FIG. 1 showing a test strip sealing engaging the orifice.
Figure 4B:
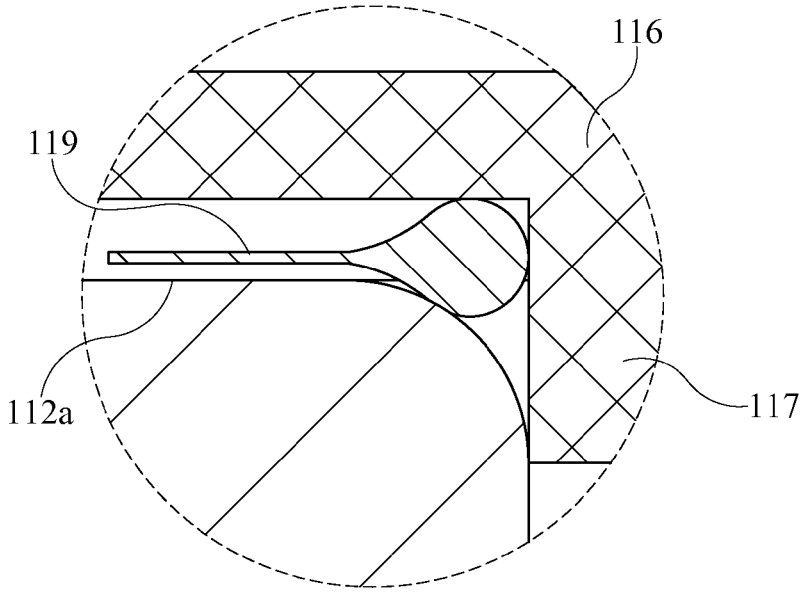
FIG. 4B is an enlarged portion of the cut-away cross-sectional view of a sump inlet of the main drain outlet of FIG. 4A showing a bulb gasket sealing the test strip to the sump inlet.

FIGS. 4A and 4B show removable test strip 116 sealing engaging orifice 104*a*. The cut-away cross-sectional views of sump inlet 112*a* of main drain outlet 100 show test strip 116 sealing engaging orifice 104*a* with gasket 119. Gasket 119 may be a bulb gasket having a rounded surface adjacent orifice 104*a* and a tail extending between sump outlet 112*a* and test strip 116. Other gaskets, as are known in the art, may be used to form a seal between test strip 116 and sump outlet 112*a*. For example, bulb seals manufactured by Simolex Rubber Corp., Plymouth, Mich., may provide a seal between test strip 116 and sump outlet 112*a*. In at least one aspect, a test strip 116 may be provided for each orifice in main drain sump 100. For example, one test strip 116 may sealingly engage orifice 104*a* and another test strip 116 may sealingly engage orifice 104*b*. Test strip 116 may comprise a portion 117 extending from a sealing surface of test strip 116 configured and disposed to extend into orifice 104*a* upon removable test strip 116 sealingly engaging orifice 104*a*.

Test strip 116 is configured and disposed to provide a seal between water inlet 112*a* and the sealing surface of removable test strip 116 with a seal sufficient to leak test main drain outlet 100. Leak testing may be performed after installation of main drain outlet 100 but prior to construction of the swimming pool, wading pool, spa, or hot tub. Leak testing of main drain 100 may be performed after connecting to main drain piping and a pump. Leak testing may be accomplished by pumping water into the main drain through the main drain pipe. The access covers may be removed to allow air to purge from the system. Upon water exiting the access ports, the access port covers may be sealed onto the access ports and the system may be brought up to a testing pressure, about 30 psi for example. The pressure may be maintained in the system during construction of the swimming pool. For example, maintaining water pressure in main drain 100 may aid in maintaining the shape of main drain 100 while a concrete floor of the swimming pool is setting.

Test strip(s) 116 may be removably secured or fastened to main drain 100 prior to shipping from a manufacturing facility and may remain in place during construction of the swimming pool, wading pool, spa, or hot tub. Extending portions 117 cooperate with inner edges of orifice 104*a* which may aid in maintaining the shape of water inlet 112*a* during construction. Additionally, test strip(s) 116 may prevent debris from entering orifice 104*a* during construction. In this aspect of the present disclosure, a swimming pool contractor or installer need not install plugs on the ends of the main drain pipes for leak testing the main drain pipes. Additionally, the main drain piping may be leak tested along with the main drain, after connecting main drain piping. In this aspect, the pool water sanitation system, from orifices 104*a* and 104*b* to a pump, may be leak tested prior to placement of concrete.

Figure 5:
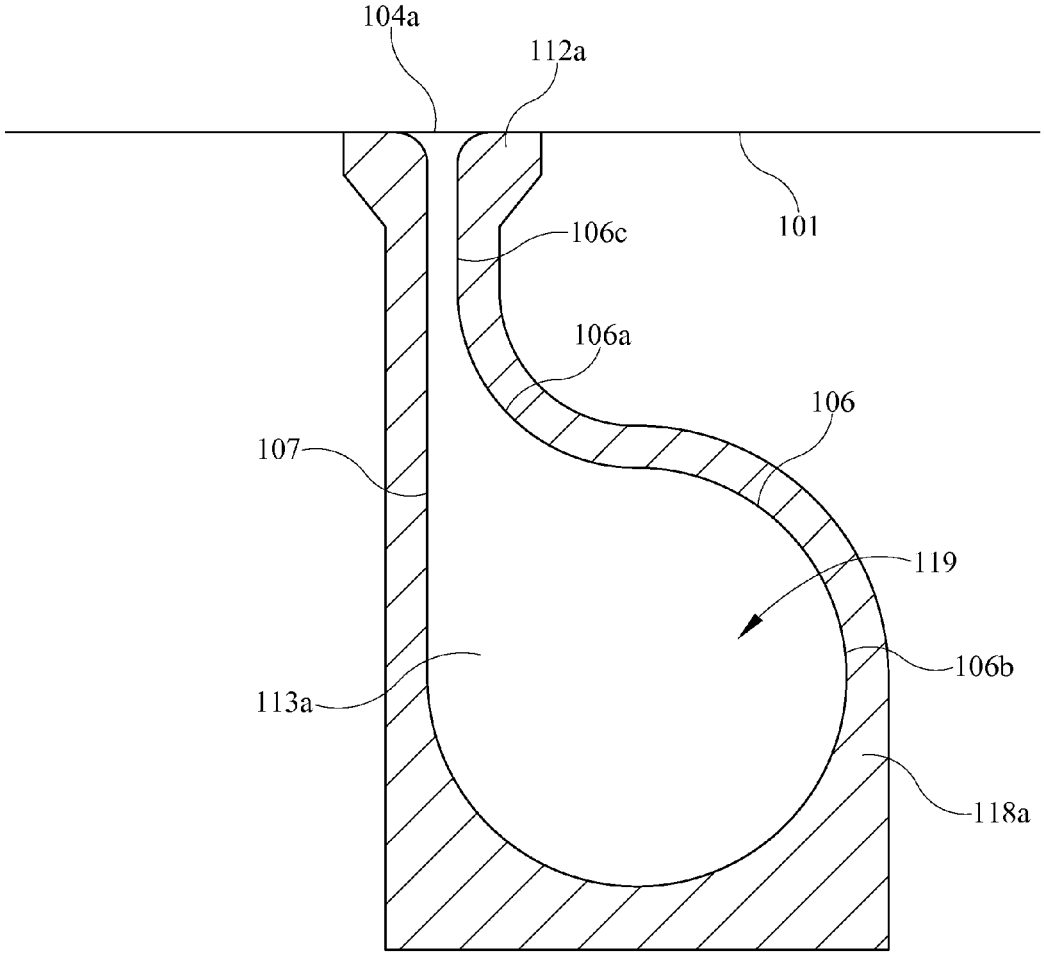
FIG. 5 is a cross-sectional view of a sump taken along sectional lines 5-5 of FIG. 1.

FIG. 5 is a cross-sectional view of a sump taken along a sectional line 5-5 of main drain outlet 100 of FIG. 1. Water inlet 112*a* is configured to be disposed substantially within an inner surface of a swimming pool, wading pool, spa, or hot tub, 101. Orifice 104*a* is in flow communication with an inner longitudinal extending cylindrical volume 119 of sump 118*a*. Sump 118*a* comprises first wall 107 and a second wall 106. First wall 107 and second wall 106 have outer edges proximate the inner surface of a swimming pool, wading pool, spa, or hot tub, 101. First wall 107 is substantially flat and extends from orifice 104*a* to second wall 106. Second wall 106 comprises an outer portion 106*c*, proximate orifice 104*a*, substantially parallel with wall 107. Curved portion 106*a* curves away from substantially flat wall 107, and an inner portion 106*b* curves to first wall 107.

Sump 118*a* has a sump volume 119 with a substantially circular cross-section formed with first wall 107, second wall 106, and two end walls 113*a* (only 1 end wall 113*a* is shown in FIG. 5). First wall 107 has a substantially flat inner surface extending from orifice 104*a*, to second wall 106 and to the two end walls 113*a*. Second wall 106 extends from orifice 104*a* to first wall 107 and to the two end walls 113*a*. Second wall 106 comprises an outer portion 106*c* extending from orifice 104*a* and disposed substantially parallel with the substantially flat inner surface of first wall 107. Second wall 106 comprises an inner portion 106*a* curving away from first wall 107 and a portion 106*b* curving back to first wall 107 forming substantially circular or cylindrical sump volume 119.

An aspect of a sump, such as sump 118*a*, may be described as having a cylindrical sump volume 119 with a sump inlet 112*a* tangentially extending from cylindrical sump volume 119. Sump inlet 112*a* has an orifice 104*a* with a length l substantially extending a longitudinal axis of cylindrical sump volume 119 and a width w substantially less than its length l. Sump 118*a* may have a curved inner surface throughout the length of orifice 104*a*.

The configuration of sump 118*a* may decrease entanglement hazards associated with the prior art. For example, jewelry, such as a pendant, may enter orifice 104*a* and rotate in sump 118*a*. The inner surfaces of sump 118*a* may be configured to increase the tendency of the pendent to rotate back to an orientation allowing it to be pulled back out of orifice 118*a*.

Figure 6A:
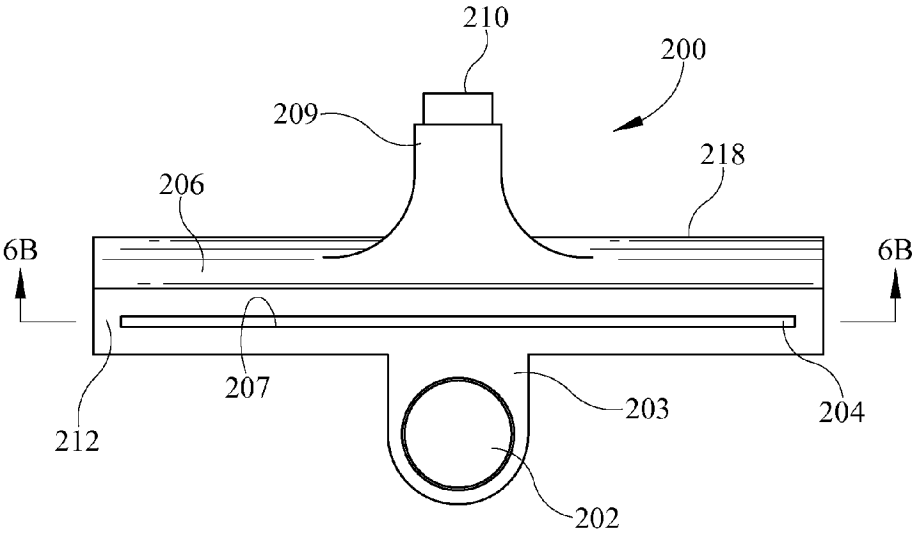
FIG. 6A is a top view of a main drain outlet for a swimming pool, wading pool, spa, or hot tub having a sole orifice.
Figure 6B:
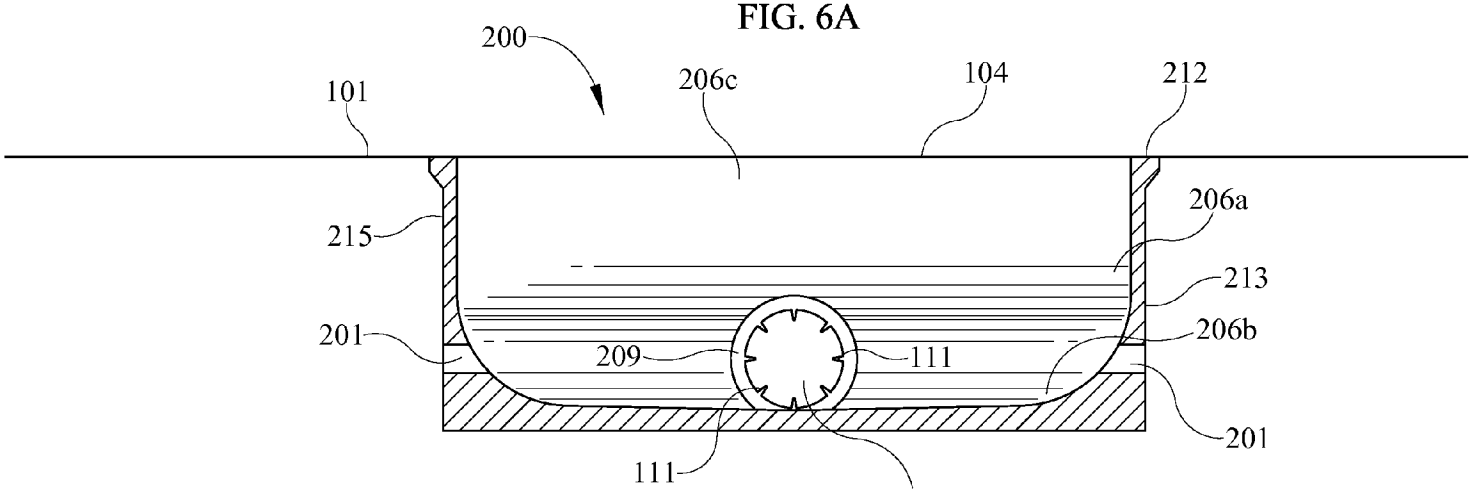
FIG. 6B is a cross-sectional view of the main drain outlet of FIG. 6A taken along sectional lines 6B-6B.

FIGS. 6A and 6B show main drain outlet 200 for a swimming pool, wading pool, spa, or hot tub having a sole orifice 204. Water inlet 212 has a planar surface configured to be disposed substantially within an inner surface of a swimming pool, wading pool, spa, or hot tub. For example, water inlet 212 may be disposed substantially even with the inner surface of the floor 101 or a wall of a swimming pool. Sump 218 is in flow communication with sole orifice 204 and sump outlet 209. Sump outlet 209 has outlet port 210 configured to be in flow communication with a main drain pipe. Sump outlet 209 may have laminar flow blades 111 extending radially inward into outlet port 210. In at least one aspect, main drain outlet 200 has an access port 203 configured and disposed to provide access to sump 218, for cleaning. Access port 203 extends from sump 218 and is centrally disposed with respect to the axial length of sump 218. Access port 203 has an opening covered with a removable access port cover 202. Removable access port cover 202 is configured to be disposed substantially within the inner surface 101 of a swimming pool, wading pool, spa, or hot tub.

Sump 218 is cylindrical and has end walls 215 and 213 enclosing axial ends thereof. Orifice 204 tangentially extends from cylindrical sump 218 to water inlet 212. Sump 218 has a first wall 207 with a substantially flat inner surface extending from orifice 204, to second wall 206 and to the two end walls 215 and 213. Second wall 206 extends from orifice 204 to first wall 207 and to the two end walls 215 and 213. Second wall 206 comprises an outer portion 206*c* extending from orifice 204 and disposed substantially parallel with the substantially flat first wall 207. Second wall 206 comprises an inner portion 206*a* curving away from first wall 207 and a portion 206*b* curving back to first wall 207, forming cylindrical sump 218. Sump 218 may have a curved inner surface throughout the length of orifice 204.

In at least one aspect of the present disclosure, a main drain outlet 200 comprises a cylindrical sump 218 with a first end wall 215 enclosing a first end of cylindrical sump 218 and a second end wall 213 enclosing a second end of cylindrical sump 218. An outlet port 209 is centrally disposed within cylindrical sump 218 and is disposed and configured to become in flow communication with main drain piping. An accessway cleanout 203 is configure to provide access into cylindrical sump 218 which has a removable cover 202 configured and disposed to cover accessway cleanout 203. An orifice 204 tangentially extends from cylindrical sump 218 and extends to first end wall 215 and second end wall 213. Cylindrical sump 218, first end wall 215, second end wall 213, outlet port 209, accessway cleanout 203, and orifice 204 may be a unitary assembly.

Figure 7:
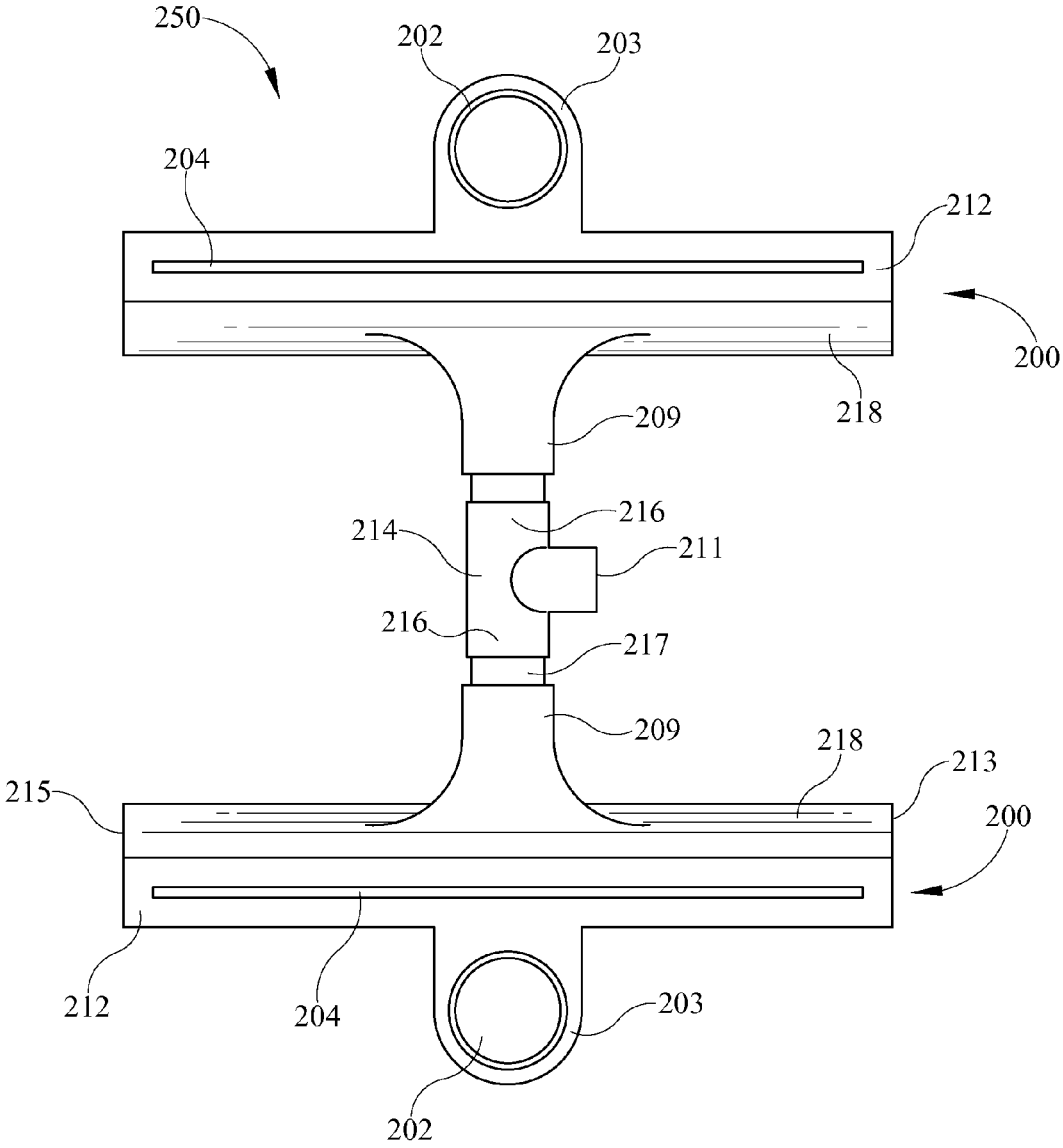
FIG. 7 is a top view of a main drain outlet for a swimming pool, wading pool, spa, or hot tub having two orifices.

FIG. 7 shows main drain outlet assembly 250 for a swimming pool, wading pool, spa, or hot tub having two orifices 204. Main drain outlet assembly 250 comprises a first main drain outlet 200 having its outlet port 209 in flow communication with an outlet port 209 of a second main drain outlet 200. Such a configuration may be desirable for larger swimming pools. Flow communication between the first and second main drain outlets 200 may be provided with a "T" connector 214. "T" connector 214 has opposing inlets 216 configured to receive a connecting or extension pipe 217. "T" connector 214 has outlet 211 configured to become in flow communication with main drain connecting piping. The outlet ports 209 may each be connected to "T" connector 214 with extension pipes 217. Advantageously, extension pipes 217 are of similar length to provide substantially similar flow through each main drain outlet 200. Optionally, "T" connector 214 has laminar flow blades extending radially inward from inner surfaces of inlets 216 and/or from an inner surface of outlet 211.

Figure 8A:
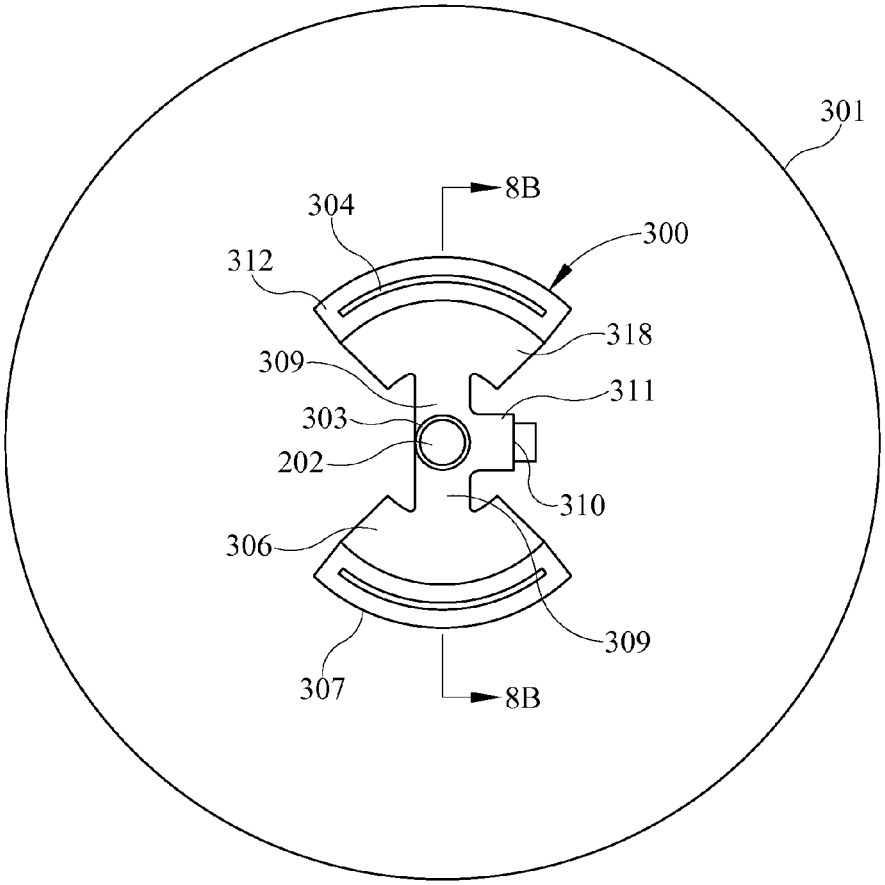
FIG. 8A is a top view of a unitary main drain outlet for a swimming pool, wading pool, spa, or hot tub having two curved orifices and configured to be disposed substantially within a flat plane of an inner surface of the swimming pool, wading pool, spa, or hot tub.
Figure 8B:
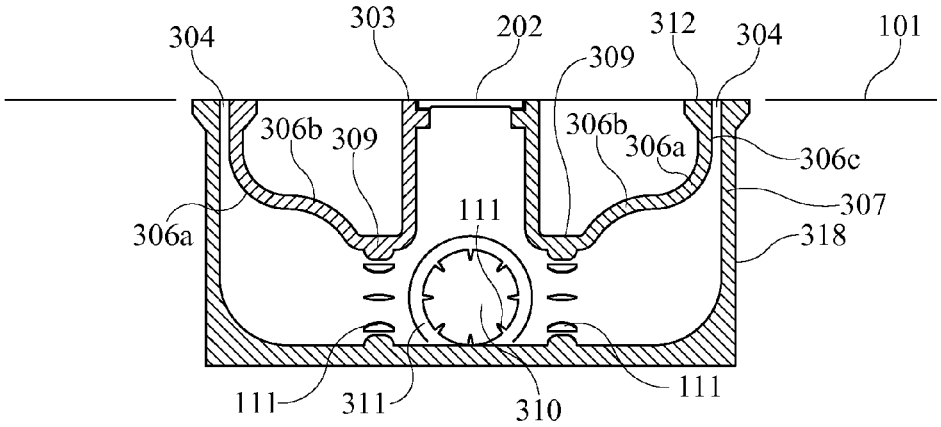
FIG. 8B is a cross-sectional view of the main drain outlet of FIG. 8A taken along sectional lines 8B-8B.

FIGS. 8A and 8B show main drain outlet 300 having curved orifices 304. This aspect of the present disclosure may be advantageous for swimming pools or hot tubs having a circular outer wall 301. FIG. 3A shows a top view of main drain outlet 300 having two curved orifices 304. A first and a second water inlet 312 have planar surfaces configured to be disposed substantially within an inner surface of a swimming pool, hot tub, or spa, for example. A first and a second sump 318 are in flow communication with a first and a second orifice 304. The first and the second sump 318 are in flow communication with a first and a second sump outlet 309. The first and second sumps 318 may have a common access port 303 configured and disposed to provide access to sumps 318, for cleaning. Access port 303 extends from sump outlets 309 and is centrally disposed with respect to the length of orifices 304. Access port 303 has an opening covered with a removable access port cover 202. Removable access port cover 202 is configured to be disposed substantially within the inner surface of a swimming pool, wading pool, spa, or hot tub. Sump outlets 309 are in flow communication with each other and main drain outlet 311. Main drain outlet 311 has water exit port 310 configured to be in flow communication with a main drain pipe. In at least one aspect, main drain outlet 309 may be in flow communication with a pump and may be referred to as a suction outlet. In another aspect, main drain outlet 311 drains sumps 318 by gravity flow, as may be advantageous in some recreational water system.

Sump outlets 309 and/or main drain outlet 311 may have laminar flow blades 111 extending inwardly. Sumps 318 are curved and cylindrical or toroidal and each comprises a first wall 307 and a second wall 306. First wall 307 and second wall 306, of each sump 318, terminate at an orifice 304 and define each sump 318 having an orifice 304 tangentially extending therefrom. Each first wall 307 comprises an outer substantially linear portion adjacent an orifice 304 and extending to a second wall 306. Each second wall 306 comprises an outer portion 306*c*, proximate an orifice 304 that is substantially linear and substantially parallel with first wall 307. Each second wall 306 comprises a portion 306*a* extending from substantially linear portion 306*c* and curving away from first wall 307. Each second wall 306 also comprising an inner portion 306*b* curving to a first wall 307. Each sump 318 has a toroidal configuration with an orifice 304 tangentially extending therefrom.

Figure 9A:
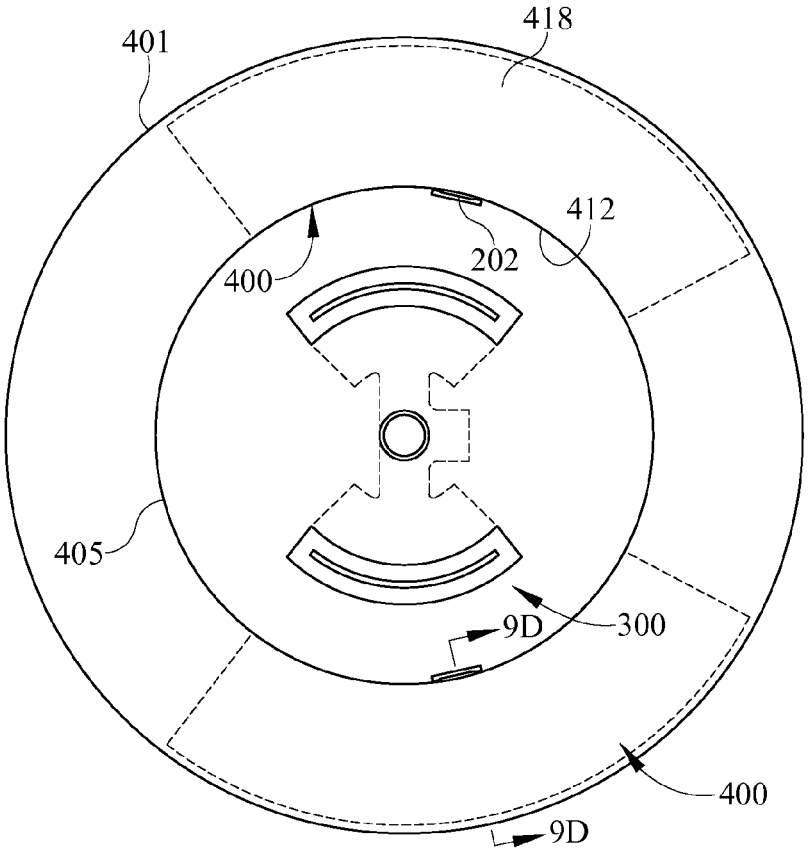
FIG. 9A is a top view of a main drain outlet installed substantially within an inwardly curved inner surface of a swimming pool, wading pool, spa, or hot tub showing a concave orifice.
Figure 9B:
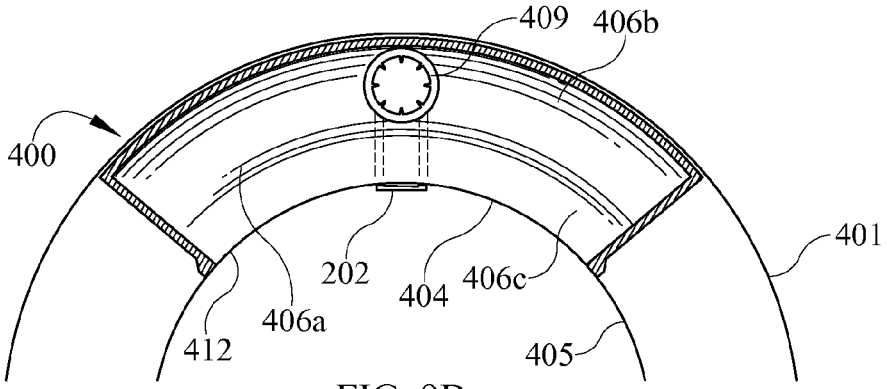
FIG. 9B is a cross-sectional view of the main drain outlet of FIG. 9A taken along sectional lines 9B-9B of FIG. 9C.
Figure 9C:
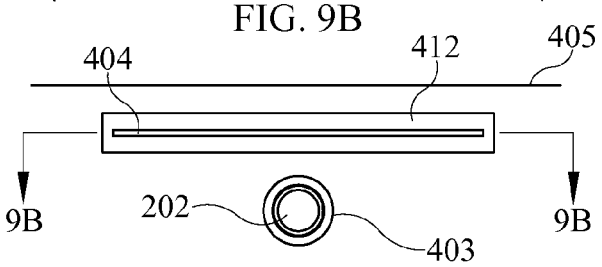
FIG. 9C is a front view of the main drain outlet of FIG. 9A showing a water inlet and an access port cover substantially within an inwardly curved inner surface of a swimming pool, wading pool, spa, or hot tub.

FIGS. 9A, 9B, 9C and 9D show an aspect of a drain outlet 400 configured to be installed into an inwardly curved inner surface of a swimming pool, wading pool, spa, or hot tub. A spa or hot tub is shown having an outer vertical wall 401 and an inner vertical wall 405. Drain outlet 400 is shown installed in inner vertical wall 405 which may have a substantially horizontal pool surface thereabove providing a seat or step, for example. Shown in the center of the floor of the spa or hot tub is a drain outlet 300, which may be installed in conjunction with one or more drain outlets 400 as shown. Drain outlet 400 has water inlet 412 substantially within inner wall 405 and proximate an upper edge of inner wall 405, as shown in FIGS. 9A and 9C.

Figure 9D:
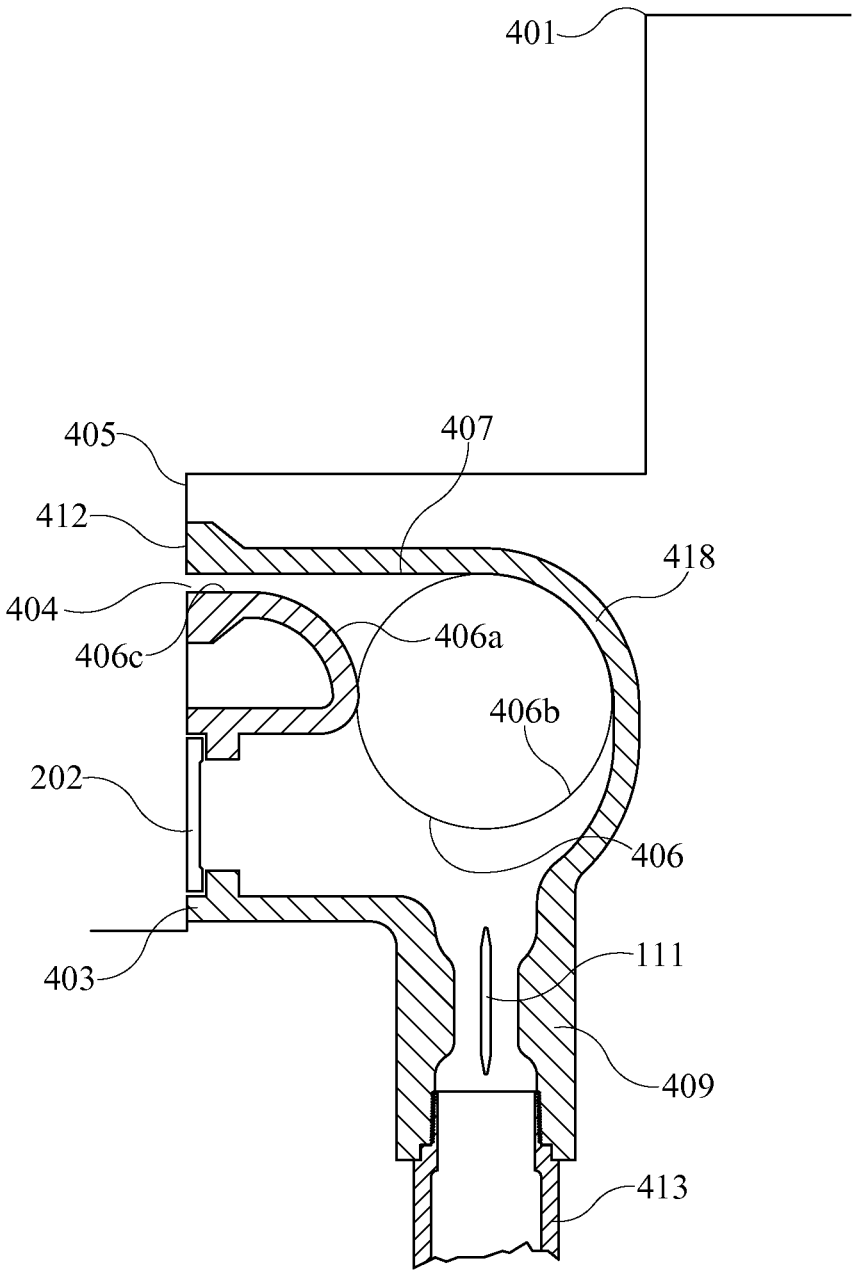
FIG. 9D is a cross-sectional view of the main drain outlet of FIG. 9A taken along sectional lines 9D-9D.

Drain outlet 400 has a curved orifice 404 in water inlet 412. Curved orifice 404 tangentially extends from curved cylindrical or toroidal sump 418. Curved cylindrical or toroidal sump 418 is in flow communication with sump outlet 409. Sump outlet 409 may have laminar flow blades 111 extending inwardly from an inner surface thereof, as shown in FIG. 9D. Access port 403 is configured and disposed to provide access to sump 418. Access port 403 extends from sump 418 and is centrally disposed with respect to the length of orifice 404. Access port 403 has an opening covered with a removable access port cover 202. Removable access port cover 202 is configured to be disposed substantially within the inner surface of inner wall 405. Sump outlet 409 is in flow communication with a main drain pipe 413. In at least one aspect, main drain outlet 409 may be in flow communication with a pump and may be referred to as a suction outlet.

As shown in FIGS. 9B and 9D, sump 418 is curved and cylindrical or toroidal and comprises a first wall 407 and a second wall 406. First wall 407 and second wall 406 terminate at orifice 404 and define sump 418 having orifice 404 tangentially extending therefrom. First wall 407 comprises an outer substantially linear portion adjacent orifice 404. Second wall 406 comprises an outer portion 406*c*, proximate orifice 404, that is substantially linear and substantially parallel with first wall 407. Second wall 406 comprises a portion 406*a* extending from substantially linear portion 406*c* and curving away from first wall 407. Second wall 406 also comprises an inner portion 406*b* curving to first wall 407. In at least one aspect, access port 403 and sump outlet 409 join sump 418 at a central portion of the curve of sump 418.

Figure 10:
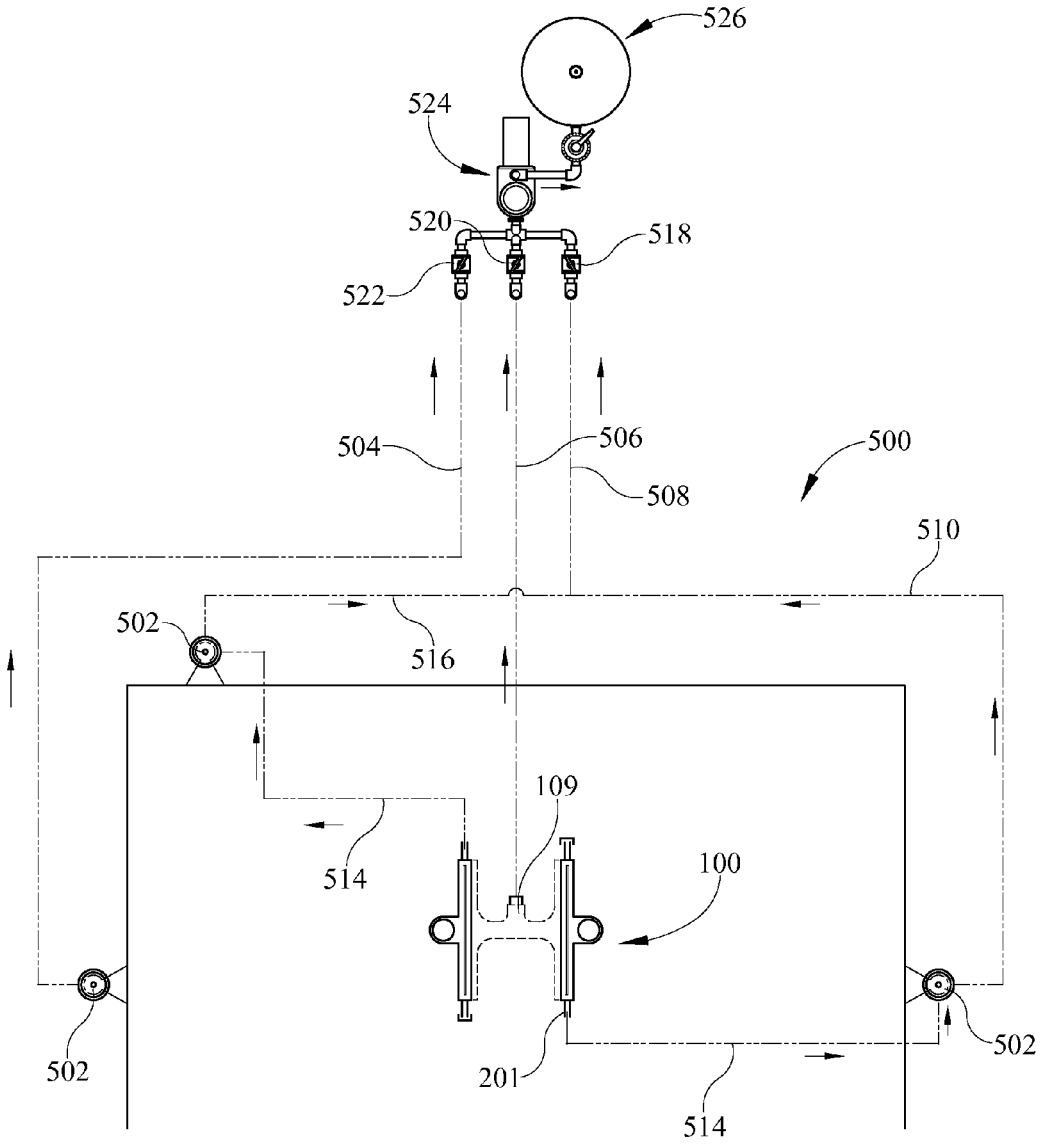
FIG. 10 is a flow diagram of a portion of a pool water sanitation system comprising the main drain outlet of FIG. 1 in flow communication with skimmers.

FIGS. 10, 11, 12 and 13 show aspects of main drain outlets of the present disclosure and aspects of water flow systems that may be incorporated therewith. FIG. 10 shows main drain outlet 100 in flow communication with skimmers 502. The aspect of main drain outlet 100 shown has ports 201 in axial ends of the sump. A skimmer flow equalizer line 514 extends from selected ports 201. Flow equalizer lines 514 provide water to skimmers 502 in the event the water level in the pool falls below the inlet of skimmers 502. Typically, in skimmers of the prior art, skimmers have flow equalizer lines in the wall of the pool below the inlet of the skimmer. Having flow equalizer lines 514 in flow communication with main drain outlet 100 eliminates the suction inlet of flow equalizer lines of the prior art by supplying water to skimmers 502 through main drain outlet 100, in the event the water level in the pool falls below the inlet of skimmers 502. The two skimmers 502 having flow equalizer lines 514 connected to main drain outlet 100 are in flow communication with each other through connecting pipe 510 and are in flow communication with pump 524 through connecting pipe 508 and valve 518. The skimmer 502 not in flow communication with main drain outlet 100 is independently in flow communication with pump 524 through connecting pipe 504 and valve 522. Outlet 109 of main drain outlet 100 is connected to main drain pipe 506, valve 520, and pump 524. Pump 524 pumps water from valves 520, 522, and 518 and through filter 526.

Figure 11:
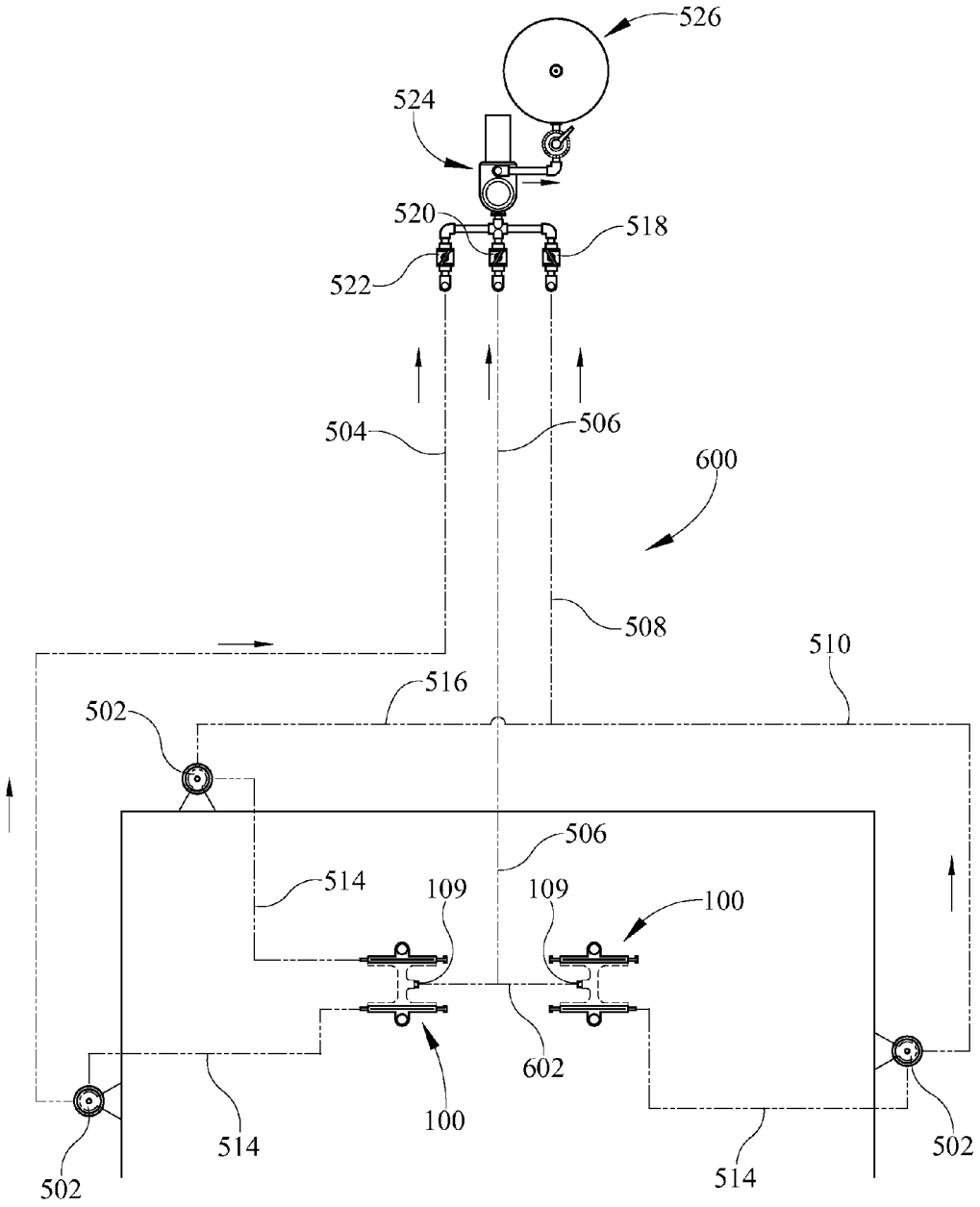
FIG. 11 is a flow diagram of a portion of a pool water sanitation system comprising two main drain outlets of FIG. 1 in flow communication with skimmers.

FIG. 11 shows main two drain outlets 100 in flow communication with each skimmer 502. Each skimmer 502 has a flow equalizer line 514 connected to a main drain outlet 100, two of which are in flow communication with each other through connecting pipe 510 and are in flow communication with pump 524 through connecting pipe 508 and valve 518. One skimmer 502 is independently in flow communication with pump 524 through connecting pipe 504 and valve 522. Outlets 109 of each main drain outlet 100 are connected to each other with connecting pipe 602, which is connected to main drain pipe 506, valve 520, and pump 524. Pump 524 is configured to pump water from valves 520, 522, and 518 and through filter 526.

Figure 12:
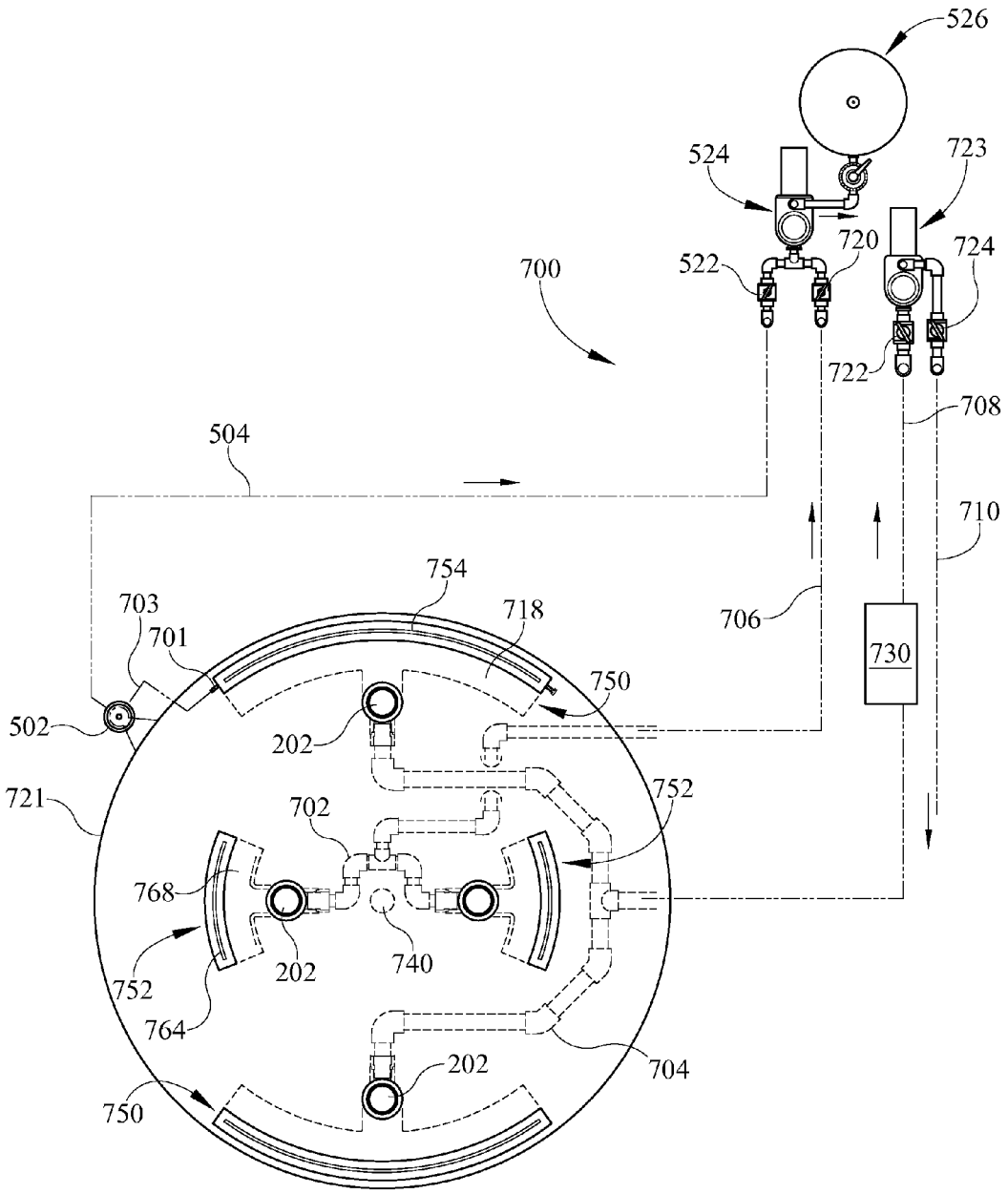
FIG. 12 is a flow diagram of a portion of a pool water sanitation system comprising main drain outlets each having curved orifices disposed substantially within a flat plane of an inner surface of the swimming pool, wading pool, spa, or hot tub.

FIG. 12 is a water flow diagram of a water sanitation system comprising main drain outlets 750 and 752, each having curved orifices disposed substantially within a flat plane of the floor of a recreational water system having a water feature 740. Water feature 740 may be a fountain or other water recreation device configured to dispense water. An outer wall or ridge 721 is configured and disposed to divert water being dispensed by water feature 740 to main drain outlets 750 and 752. Main drain outlets 752 are disposed proximate a center of wall or ridge 721 and have a curved orifice 764 extending into the floor of the recreational water system and tangentially into curved cylindrical or toroidal sump 768. Main drain outlets 752 have outlets connected with connecting line 702, which is connected to line 706 and pump 524 through valve 720.

Main drain outlets 750 are disposed proximate wall or ridge 721 and have a curved orifice 754 extending into the floor and tangentially into curved cylindrical or toroidal sump 718. Main drains outlets 750 have outlets connected with each other with connecting line 704, which is connected to service tank 730. Service tank 730 may be open to the atmosphere, providing gravity flow from main drain outlets 750. In at least one aspect, service tank 730 is enclosed and has a volume of air therein, providing a more consistent suction to main drain outlets 750. In another aspect, all main drain outlets 750 and 752 have their outlets connected to service tank 730. Service tank 730 is connected to pump 723 with connecting line 708 and valve 722. Water pumped from service tank 730 may be pumped back to water feature 740 through valve 724 and connecting line 710. One main drain outlet 750 has a skimmer flow equalizer line 703 connected to a longitudinal end of sump 718 at inlet port 701. Skimmer 502 is connected to pump 524 through connecting line 504 and valve 522. Pump 524 is configured to pump water from main drain outlets 752 and skimmers 502. In the event the water level falls below an inlet of skimmer 502, pump 524 is configured to pump water from main drain outlets 750 as well.

Figure 13:
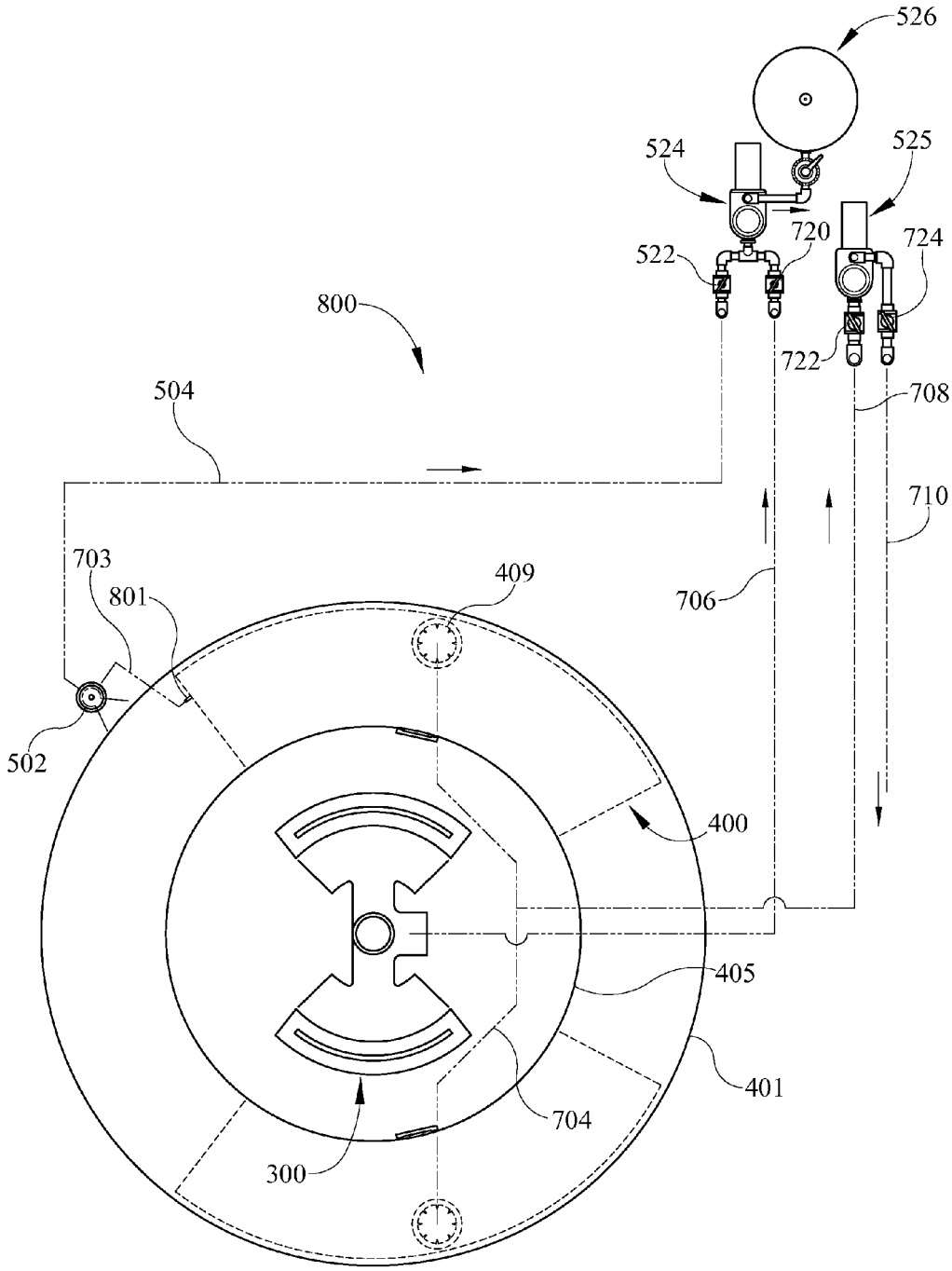
FIG. 13 is a flow diagram of a portion of a pool water sanitation system comprising main drain outlets shown in FIGS. 8A and 9A.

FIG. 13 shows a flow diagram of water sanitation system comprising main drain outlets 400 and main drain outlet 300. A hot tub or spa is shown having an outer wall 401 and an inner wall 405. Main drain outlet 300 is centrally disposed in the floor of the spa or hot tub while main drain outlets 400 are disposed about the surface of inner wall 405. Main drain outlet 300 is connected to pump 524 with connecting line 706 and valve 720. The outlet of each main drain outlet 400 is connected to the other with connecting line 704 and to pump 525 through connecting line 708 and valve 722. A skimmer 502 has a flow equalizer line 703 connected to a main drain outlet 400. Skimmer 502 is connected to pump 524 through connecting line 504 and valve 522. Pump 524 is configured to pump water from main drain outlet 300 and a main drain outlet 400, in the event the water level in the tub or spa drops below the intake of skimmer 502, and through filter 526. Pump 525 is configured to pump water from main drain outlets 400 and out through valve 724 and line 710.

Figure 14:
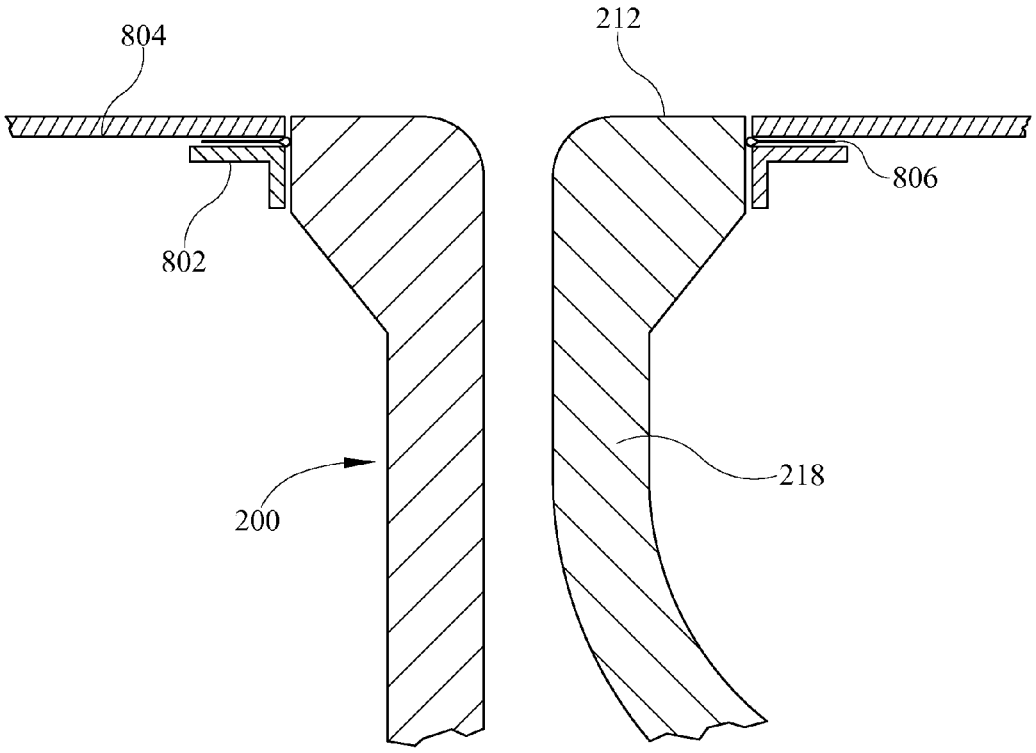
FIG. 14 is a cross-sectional view of a portion of a main drain outlet wherein the main drain outlet is installed in a non-concrete pool.

FIG. 14 shows an outer portion of main drain 200 installed into a pool having a shell 804, constructed of a non-concrete material such as fiberglass or the vinyl-liner type, for example. Inlet 212 is adjacent shell 804 about its perimeter. A gasket 806, for example a bulb gasket, is continuous and is configured to provide a seal between shell 804 and inlet 212. Bracket 802 is on a side of seal 806 opposite shell 804 and is configured to hold gasket 806 in a sealing configuration with shell 804 and main drain 200. Adhesives may be used to help maintain a seal between shell 804 and main drain 200.

Aspects of the present disclosure provide a main drain outlet and a water sanitation system for a swimming pool, wading pool, spa, or hot tub. A main drain outlet comprises a cylindrical or toroidal sump, an inlet tangentially extending from the cylindrical or toroidal sump having an orifice with a length extending a longitudinal axis of the cylindrical or toroidal sump and a width substantially less than its length. The sump may have a curved inner surface throughout the length of the orifice. The main drain outlet may be unitary and may have more than one sump and corresponding inlet and may be configured to be installed into a planar or curved bottom or wall surface of a swimming pool, wading pool, spa, or hot tub. The main drain outlet may comprise a testing strip. The pool water sanitation system may comprise skimmer flow equalizer lines in flow communication with a main drain outlet. The main drain outlet may be configured and disposed to provide a suction outlet or may be configured and disposed to provide a gravity flow outlet for a swimming pool, wading pool, spa, or hot tub.

The invention is illustrated by example in the drawing figures, and throughout the written description. It should be understood that numerous variations are possible, for example a variation of the disclosure to serve as a skimmer, while adhering to the inventive concept. Such variations are contemplated as being a part of the present invention.

The invention claimed is:

1. A unitary main drain suction outlet for a swimming pool comprising:

a first water inlet configured to be disposed substantially within an inner surface of the swimming pool;

a first longitudinal orifice in said first water inlet having a length substantially larger than a width;

a first sump in flow communication with said first orifice and a first sump outlet;

said first sump comprising a first wall and a second wall;

said first wall and said second wall having said first orifice therebetween;

a pump configured and disposed to pump water from the swimming pool, into said first orifice, through said first sump, and through said first sump outlet;

said first orifice being configured and disposed to maintain any vacuum on a human body below a vacuum required for entrapment or evisceration of the human body upon the human body maximizing blockage of the flow of water into said first orifice when said pump is pumping water;

said first wall comprising a substantially flat portion extending from a first longitudinal edge of said first orifice; and said second wall extending from a second longitudinal edge of said first orifice and comprising an outer portion, proximate said first orifice, curving away from said substantially flat portion of said first wall and an inner portion curving to said first wall, wherein said inner and said outer portions of said second wall form a circular portion of said sump.

2. The main drain suction outlet for a swimming pool of claim 1 further comprising:

a second water inlet configured to be disposed substantially within the inner surface of the swimming pool;

a second longitudinal orifice in said second water inlet having a length substantially larger than a width;

a second sump in flow communication with said second orifice and a second sump outlet;

said second sump comprising a first wall and a second wall;

said first wall of said second sump and said second wall, of said second sump, having said second orifice therebetween;

said second sump outlet being in flow communication with said first sump outlet;

said pump being configured and disposed to pump water out of said main drain suction outlet through said first sump outlet and said second sump outlet;

said first wall of said second sump comprising a substantially flat portion extending from a first longitudinal edge of said second orifice; and said second wall of said second sump extending from a second longitudinal edge of said second orifice and comprising an outer portion, proximate said second orifice, curving away from said substantially flat portion of said first wall of said second sump and an inner portion curving to said first wall of said second sump.

3. The main drain suction outlet for a swimming pool of claim 2 wherein said first and said second water inlets, said first and said second sumps, and said first and said second sump outlets are of a unitary assembly.

4. The main drain suction outlet for a swimming pool of claim 1 wherein said first orifice has a length of at least 38 inches.

5. The main drain suction outlet for a swimming pool of claim 1 wherein said first sump comprises a port configured to be in flow communication with at least one skimmer equalizer line.

6. A main drain outlet for a swimming pool, wading pool, spa, or hot tub, said main drain outlet comprising:

an orifice having a length substantially greater than a width;

said orifice being configured to be disposed substantially within an inner surface of the swimming pool, wading pool, spa, or hot tub;

a substantially circular sump comprising a first wall, a second wall, and two end walls;

said first wall being substantially flat and extending from said orifice to said second wall and to said two end walls;

said second wall extending from said orifice to said first wall and to said two end walls;

said second wall comprising:

an outer portion extending from said orifice and disposed substantially parallel with said first wall; and an inner portion extending from said outer portion of said second sidewall and curving away from said first wall and then curving back to said first wall, forming said substantially circular sump; and a sump outlet in flow communication with said orifice, said sump outlet extending from said inner portion of said second wall and centrally disposed with respect to said two end walls.

7. The main drain outlet of claim 6 further comprising an access port and a removable access port cover, said access port being configured and disposed to provide access to said sump, said access port extending from said first wall and centrally disposed with respect to said two end walls and having an opening covered with said removable access port cover, said removable access port cover being configured to be disposed substantially within the inner surface of the swimming pool, wading pool, spa, or hot tub.

8. The main drain outlet of claim 6 further comprising a plurality of laminar flow blades, each said plurality of laminar flow blades being substantially equidistantly spaced about an inner perimeter of said sump outlet and extending inwardly from said inner perimeter of said sump outlet, each said plurality of laminar flow blades having a length substantially greater than a width and having its length disposed substantially parallel with a direction of flow through said sump outlet.

9. The main drain outlet of claim 6 wherein said orifice is straight and flat and configured to be disposed substantially within a flat plane of the inner surface of the swimming pool, wading pool, spa, or hot tub.

10. The main drain outlet of claim 6 wherein said orifice is curved about said sump outlet and configured to be disposed substantially within a flat plane of the inner surface of the swimming pool, wading pool, spa, or hot tub.

11. The main drain outlet of claim 6 wherein said orifice is curved about said sump outlet and configured to be disposed substantially within an inwardly curved inner surface of the swimming pool, wading pool, spa, or hot tub.

12. The main drain outlet of claim 6 wherein said sump comprises a skimmer equalizer port in at least one of said two end walls, said skimmer equalizer port being configured to provide flow communication between said sump and a skimmer flow equalizer line.

13. The main drain outlet of claim 6 wherein said sump outlet is in flow communication with a pump configured and disposed to pump water from the swimming pool, wading pool, spa, or hot tub, through said orifice, said sump, and said sump outlet.

14. The main drain outlet of claim 6 wherein said sump outlet is in flow communication with a water service tank configured and disposed to receive water from the swimming pool, wading pool, spa, or hot tub, by gravity flow through said orifice, said sump, and said sump outlet.

15. The main drain outlet of claim 12 wherein said sump outlet is in flow communication with a pump configured and disposed to pump water from the swimming pool, wading pool, spa, or hot tub, through said orifice, said sump, and said sump outlet, and to pump water from the swimming pool, wading pool, spa, or hot tub, through at least one skimmer flow equalizer, at least one skimmer flow equalizer line, said skimmer equalizer port, said sump, and said sump outlet.

16. A main drain outlet assembly for a swimming pool, wading pool, spa, or hot tub, said main drain outlet assembly comprising at least two said main drain outlets of claim 6 wherein said sump outlet of each said main drain outlet are in flow communication with one another and a main drain connecting pipe.

17. The main drain outlet assembly of claim 16 wherein said at least two main drain outlets are of a unitary assembly.

18. A main drain outlet for a swimming pool, wading pool, spa, or hot tub comprising:

a cylindrical sump;

a sump inlet tangentially extending from said cylindrical sump and having an opening with a length extending a longitudinal axis of said cylindrical sump and a width substantially less than its length; and said sump having a curved inner surface throughout the length of said sump inlet.

19. A main drain outlet comprising:

a cylindrical sump;

a first end wall enclosing a first end of said cylindrical sump;

a second end wall enclosing a second end of said cylindrical sump;

an outlet port centrally disposed within said cylindrical sump;

said outlet port being configured to become in flow communication with main drain piping;

an accessway cleanout configured to provide access into said cylindrical sump;

a removable cover configured and disposed to cover said accessway cleanout;

an orifice tangentially extending from said cylindrical sump and extending proximate said first and said second end walls; and said cylindrical sump, said first end wall, said second end wall, said outlet port, said accessway cleanout, and said orifice being a unitary assembly.

* * * * *